US008480520B2

(12) United States Patent
Webber et al.

(10) Patent No.: US 8,480,520 B2
(45) Date of Patent: Jul. 9, 2013

(54) ADJUSTABLE ARROW INSERT ASSEMBLY AND METHOD OF USE

(75) Inventors: Jerry D. Webber, Spencerville, IN (US); Jerry G. Webber, Butler, IN (US)

(73) Assignee: Webb Products, Inc., Butler, IN (US)

( * ) Notice: Subject to any disclaimer, the term of this patent is extended or adjusted under 35 U.S.C. 154(b) by 0 days.

(21) Appl. No.: 13/444,184

(22) Filed: Apr. 11, 2012

(65) Prior Publication Data

US 2012/0270688 A1 Oct. 25, 2012

Related U.S. Application Data

(60) Provisional application No. 61/477,389, filed on Apr. 20, 2011.

(51) Int. Cl.
*F42B 6/08* (2006.01)

(52) U.S. Cl.
USPC ..... 473/582; 473/583

(58) Field of Classification Search
USPC ..... 473/578, 582, 583
See application file for complete search history.

(56) References Cited

U.S. PATENT DOCUMENTS

| | | | | |
|---|---|---|---|---|
| 4,006,901 | A | 2/1977 | Simo | |
| 4,203,601 | A | 5/1980 | Simo | |
| 4,210,330 | A | 7/1980 | Kosbab | |
| 4,534,568 | A | 8/1985 | Tone | |
| 4,621,817 | A | 11/1986 | Musacchia | |
| 4,671,517 | A | 6/1987 | Winters | |
| 4,781,386 | A | 11/1988 | Armitage | |
| 4,943,067 | A | 7/1990 | Saunders | |
| 5,803,843 | A | 9/1998 | Anderson et al. | |
| 5,823,902 | A | 10/1998 | Guest et al. | |
| 5,902,199 | A * | 5/1999 | Adams, Jr. | 473/578 |
| 6,887,172 | B2 | 5/2005 | Arasmith | |
| 7,207,908 | B1 | 4/2007 | Gizowski | |
| 7,232,390 | B2 | 6/2007 | Mizek et al. | |
| 7,318,783 | B2 | 1/2008 | Polando | |
| 7,338,397 | B2 | 3/2008 | Mizek et al. | |
| 7,651,421 | B2 | 1/2010 | Smith et al. | |
| 8,016,703 | B1 * | 9/2011 | Kronengold et al. | 473/582 |
| 2009/0124439 | A1 | 5/2009 | Sullivan | |

OTHER PUBLICATIONS

Sullivan Industries Inc., Innerloc Broadheads, Tuning the new BAT broadheads, www.innerloc.com/pages/bat-tech3.htm, copyright 1997-2011.

* cited by examiner

*Primary Examiner* — John Ricci
(74) *Attorney, Agent, or Firm* — Bose McKinney & Evans LLP

(57) ABSTRACT

An insert assembly for an arrow that includes a sleeve and a nut which can selectively secure an arrowhead in a desired rotational position on an arrowshaft wherein the arrowhead has a threaded stem that is fixed relative to the arrowhead. The sleeve is secured at the fore end of the arrowshaft and the nut is positioned at the aft end of the sleeve. The threaded stem is inserted through the sleeve and secured to the nut. In one embodiment, the nut is engaged with a tool inserted through the aft end of the arrowshaft to secure the nut with the arrowhead. In another embodiment, the sleeve includes axially extending crimp arms extending rearwardly from the sleeve to axially capture the nut.

20 Claims, 5 Drawing Sheets

ADJUSTABLE ARROW INSERT ASSEMBLY AND METHOD OF USE

CROSS REFERENCE TO RELATED APPLICATIONS

This application claims priority under 35 U.S.C. 119(e) of U.S. provisional patent application Ser. No. 61/477,389 filed on Apr. 20, 2011 entitled ADJUSTABLE ARROW INSERT ASSEMBLY AND METHOD OF USE the disclosure of which is hereby incorporated herein by reference.

BACKGROUND OF THE INVENTION

The present invention relates to archery equipment and, more particularly to an arrow insert that allows for the rotational adjustment of an arrowhead relative to the arrowshaft.

Archery equipment has undergone rapid development in recent years. One of the more significant changes that has occurred has been the development of compound bows capable of firing arrows at increasingly greater speeds. Such compound bows are often used for hunting purposes. Crossbows which are typically capable of generating relatively high speeds are also becoming increasingly common.

Higher arrow speed has many advantages. For example, it minimizes the time interval during which the game animal might react to the sound of the bow and the impact of the arrow and may thereby enhance shot placement accuracy. Higher speeds also provide for relatively "flatter" arrow flight trajectories within the effective range of the bow which can also enhance accuracy.

Higher arrow speeds, however, are not without drawbacks. One of the primary drawbacks of shooting a compound bow with a relatively high arrow speed is that such bows typically amplify flaws in the arrow being shot. For example, if an arrow is not rotationally balanced, it may not fly true. Moreover, an arrow that flies true with a lower speed bow, may no longer fly true when fired at the higher speeds which can be produced by many new compound bows. As a result, such high speed compound bows are often referred to as "unforgiving" in comparison to compound bows with lower arrow speeds and more traditional bows such as long bows and recurve bows.

Many factors can influence the ability of an arrow to fly true. For example, the "spine" or rigidity of the shaft and the distribution of weight along the longitudinal length of the arrowshaft can influence the flight of an arrow. Adjusting the various physical properties of an arrow to achieve a truer flight path is commonly referred to as "tuning" the arrow.

"Broadheads" are a common type of arrowhead used for hunting and have a plurality of sharp projections or blades that extend radially outwardly from the arrowhead. Broadheads, as well as field points and other types of arrowheads, typically have a threaded shaft that engages a threaded insert that is mounted in the forward end of an arrowshaft. Many people think that the rotational position of the broadhead blades relative to the fletchings on the arrowshaft influences the flight of the arrow. As a result, a person "tuning" an arrow will oftentimes desire to adjust the rotational position of the broadhead blades relative to the fletchings of the arrow.

There are some devices currently available that allow for the rotational adjustment of a broadhead. For example, a number of broadheads currently available do allow an archer to adjust the rotational position of the projecting blades relative to the threaded stem that attaches the broadhead to the shaft. Many archers, however, desire an expansion of the available options for adjusting the rotational position of the projecting blades of a broadhead.

SUMMARY OF THE INVENTION

The present invention provides an arrow insert assembly that allows for the rotational adjustment of an arrowhead relative to the arrowshaft.

The invention comprises, in one form thereof, an arrow insert assembly adapted for installation in an arrowshaft having a longitudinally extending bore and further adapted to secure an arrowhead including a threaded stem to the arrowshaft. The insert assembly includes a hollow tubular sleeve securable within the bore of the arrowshaft and a nut having a threaded bore and being rotatably positionable within the bore of the arrowshaft aft of at least a portion of the tubular sleeve. The arrowhead is securable to the arrowshaft in a desired rotational position by extending the threaded stem through the tubular sleeve and securely engaging the threaded stem with the threaded bore of the nut.

The invention comprises, in another form thereof, an arrow assembly that includes an arrowshaft having a longitudinally extending bore and an arrowhead including a plurality of outwardly extending blades and a threaded stem, the stem being fixed and immovable relative to the blades. The arrow assembly also includes a hollow tubular sleeve secured within the bore of the arrowshaft and a nut having a threaded bore, the nut being positioned aft of at least a portion of the tubular sleeve wherein the arrowhead is secured to the arrowshaft by extending the threaded stem through the tubular sleeve to securely engage the threaded bore of the nut.

The invention comprises, in yet another form thereof, a method of securing an arrowhead having a threaded stem to an arrowshaft having a longitudinally extending bore. The method includes installing a hollow tubular sleeve within the bore of the arrowshaft; positioning a nut having a threaded bore within the bore and aft of at least a portion of the sleeve, the nut being rotatable relative to the tubular sleeve; and securing the arrowhead in a desired rotational position by inserting the threaded stem of the arrowhead through the sleeve and threadingly and securely engaging the stem with the threaded bore of the nut.

In some embodiments, the insert assembly is adapted for use with an arrowshaft having an opening at the aft end of the shaft such as a carbon fiber shaft. In this embodiment, the nut is engaged with a tool inserted through the aft end of the arrowshaft to engage and rotatably drive the nut and threadingly engage the nut with the threaded stem of the arrowhead. In some embodiments, the tool has a collapsible shaft with at least one pivotal link.

In another embodiment, the insert assembly is adapted for use with an arrowshaft having a closed aft end such as an aluminum shaft. In this embodiment, the sleeve includes axially extending crimp arms extending rearwardly from the sleeve. The crimp arms axially capture the nut but allow rotational movement of the nut relative to the sleeve. The threaded stem of the arrowhead is inserted through the sleeve and engaged with the nut. To secure the arrowhead, the arrowhead is rotated relative to the arrowshaft to threadingly engage the stem with the nut. If the final secured position of the arrowhead is not the desired rotational position of the arrowhead, the arrowhead is loosened from the nut, the nut is allowed to rotate relative to the sleeve and then the arrowhead is re-secured. This process is repeated until the arrowhead is secured in the desired rotational position.

In some embodiments, the insert assembly comes with a plurality of nuts which define a plurality of different weights whereby a selected one of the nuts can be utilized to secure the arrowhead and thereby selectively control the distribution of weight along the arrowshaft.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
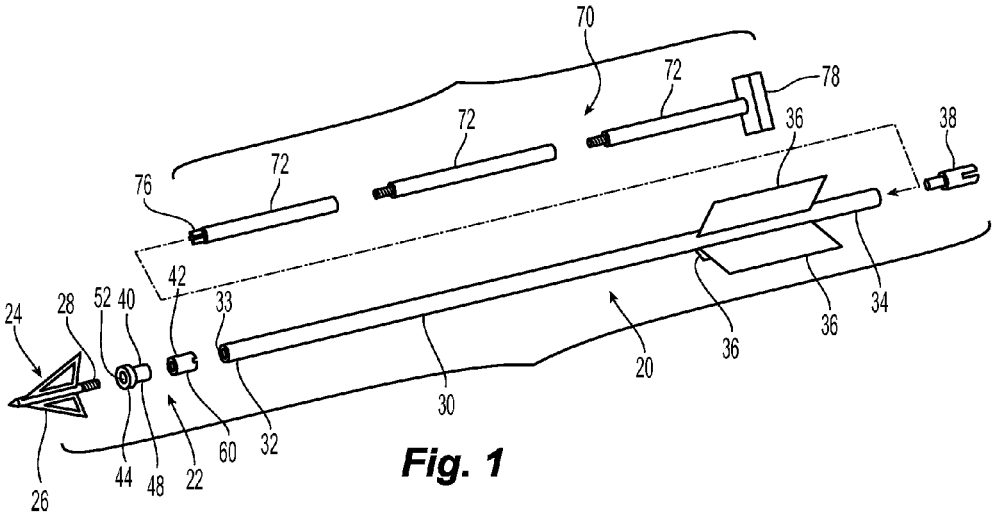
FIG. 1 is an exploded perspective view of an arrow utilizing one embodiment of an adjustable insert and a tool used with the adjustable insert.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE INVENTION

An arrow assembly 20 having an adjustable insert assembly 22 is illustrated in FIG. 1. In addition to the adjustable insert assembly 22, arrow 20 includes a broadhead 24 having a plurality of radially outwardly extending blades 26 and a threaded stem 28. Broadhead 24 is a conventional broadhead wherein blades 26 do not rotate relative to stem 28. Blades 26 may be removable, for sharpening or replacement, or permanently affixed to broadhead 24.

Arrow 20 also includes a shaft 30 having a fore end 32 and an aft end 34. Insert assembly 22 and broadhead 24 are secured to shaft 30 at fore end 32. A plurality of fletchings 36, typically three fletchings, extend radially outwardly from the shaft 30 proximate aft end 34. A nock 38 is installed in the aft end 34 of shaft 30 for engagement with the string of the bow used to fire arrow 20.

In the embodiment illustrated in FIG. 1, shaft 30 is a conventional carbon fiber shaft in the form of a hollow cylindrical tube which is open at both the fore and aft ends 32, 34. As mentioned above, broadhead 24 is a conventional broadhead. Similarly, fletchings 36 and nock 38 are conventional and employed with shaft 30 in a manner well known to those having ordinary skill in the art. While specific arrow assemblies 20 are shown and described herein, the present invention may be used with a variety of different arrow assemblies adapted for use with a variety of different bows. For example, the present invention may be used with arrows adapted for use with compound bows and more traditional bows such as recurve bows and long bows. The present invention may also be used with arrows specifically adapted for use with crossbows which are commonly referred to as "bolts".

Figure 2:
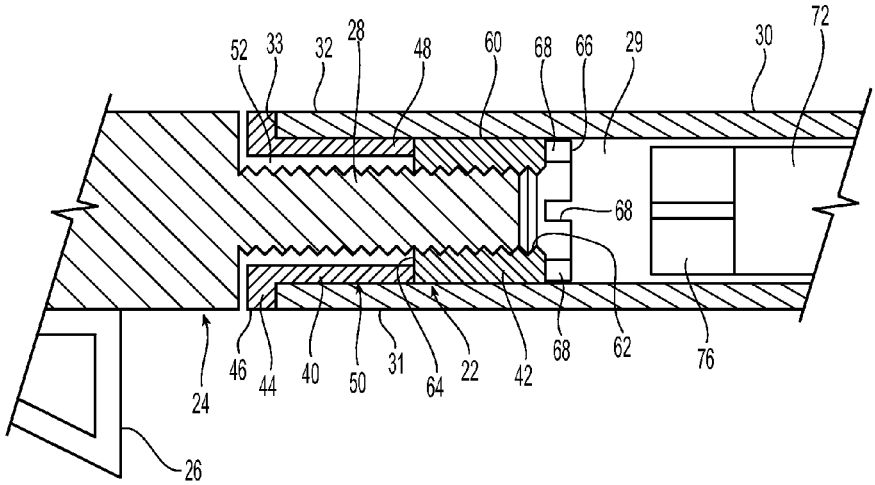
FIG. 2 is a cross sectional view of the arrow assembly with the adjustable insert of FIG. 1 in an installed condition.
Figure 3:
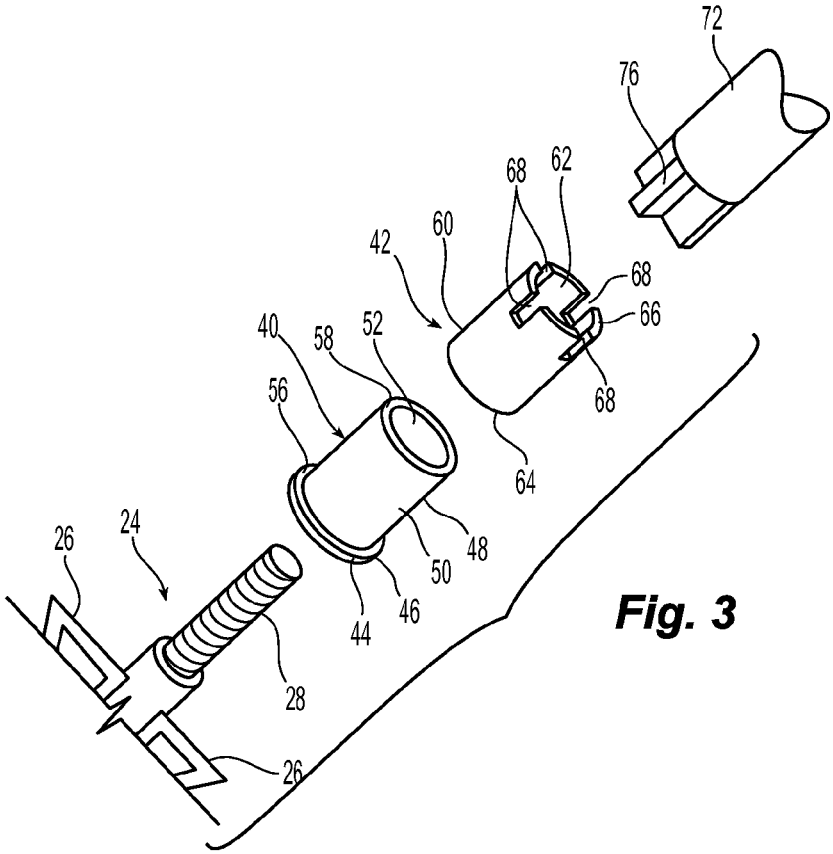
FIG. 3 is an exploded perspective view of a broadhead, the adjustable insert of FIG. 1 and an installation tool.

As can be seen in FIGS. 1-3, adjustable insert assembly 22 includes both a sleeve 40 and a nut 42. Sleeve 40 is secured in the fore end 32 of shaft 30. Sleeve 40 includes a radially outwardly projecting flange or collar 44 that has an outermost surface 46 that defines a diameter substantially similar to the diameter defined by the outermost surface 31 of shaft 30. Sleeve 40 also has a tubular section 48 which has an outer surface 50. Outer surface 50 has a diameter sized to tightly fit within bore 29 of shaft 30. An axial bore 52 extends through sleeve 40 and has a diameter sufficiently large to allow the passage of threaded stem 28 therethrough without inhibiting the axial passage or rotational movement of threaded stem 28. In the illustrated embodiment, bore 52 does not engage threaded stem 28.

Sleeve 40 is secured to shaft 30 by inserting tubular section in bore 29 as can be seen in FIG. 2. Sleeve 40 is securely affixed to shaft 30 either by the press-fit engagement between sleeve 40 and bore 29, by applying a layer of adhesive between exterior surface 50 of tubular section 48 and bore 29, or other suitable means known to those having ordinary skill in the art. Sleeve 40 is installed in shaft 30 in a manner similar to the installation in an arrowshaft of a conventional insert having a threaded interior. Conventional arrow inserts have a shape and construction generally similar to sleeve 40 but include a threaded bore for directly engaging and securing the threaded stem 28 of an arrowhead.

Figure 4:
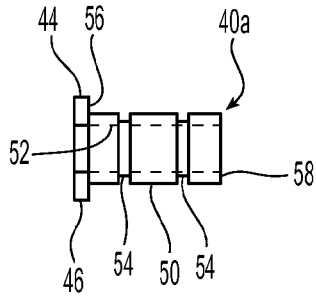
FIG. 4 is a side view of an alternative embodiment of a sleeve for an adjustable insert.

FIG. 4 illustrates an alternative sleeve 40*a* which includes circumferentially extending grooves 54 in exterior surface 50 and is particularly well adapted for securing sleeve 40*a* to a shaft 30 with adhesive. Grooves 54 are useful for retaining adhesive during the securement of sleeve 40*a* to shaft 30. The use of such adhesive grooves with conventional inserts is known in the art.

When installing sleeves 40, 40*a* in an arrowshaft 30, tubular section 48 is inserted in bore 29 of shaft 30 until the aft-facing surface 56 of collar 44 is engaged with the axial face 33 of fore end 32. When mounting an arrowhead, the arrowhead engages the collar 44 while nut 42 engages the opposite end of the sleeve defined by aft-facing surface 58 of tubular section 48 as discussed below.

Nut 42 is positioned within bore 29 aft of sleeve 40. Nut 42 is dimensioned to allow nut 42 to be rotated within bore 29. In the illustrated embodiment, nut 42 has a cylindrical exterior surface 60 which is sufficiently smaller than the interior diameter of bore 29 to allow for relatively easy rotation of nut 42 but sufficiently large so that positioning nut 42 within bore 29 properly centers and positions nut 42 within bore 29. Nuts 42 may also be used which have alternative shapes, for example a nut having an outer perimeter defining a hexagon or octagon could be used provided that such nuts were rotatable within bore 29. Nut 42 includes a threaded bore 62 which is threadingly engageable with threaded stem 28. Nut 42 also has an axial face 64 on the fore end of nut 42 that is generally planar. The axial face 66 on the aft end of nut 42 defines a plurality of slots 68 that are engageable with a driver. In the illustrated embodiment, slots 68 are engageable with a driver having a "Phillips" head configuration, however, other configurations which allow for the rotational driving of nut 42 can also be employed with nut 42.

When installing an arrowhead on shaft 30, nut 42 is positioned within bore 29 aft of sleeve 40 which is securely affixed to shaft 30. The threaded stem 28 of the arrowhead is inserted through sleeve 40 and engaged with threaded bore 62 of nut 42. The arrowhead is positioned in a desired rotational position, e.g., broadhead blades 26 are rotationally aligned with fletchings 36, and the nut 42 is then rotated within bore 29 until the axial face 64 of the fore end of nut 42 firmly and securely engages the aft-facing surface 58 of sleeve 40 thereby securing the arrowhead to shaft 30. Although the illustrated embodiment shows stem 28 having threads extending the full length of stem 28, the present invention can also be employed with arrowheads having a stem wherein a portion of the stem has a non-threaded exterior, e.g., a smooth cylindrical shank, with only the most distal portion of the stem being threaded.

A tool 70 is illustrated in FIG. 1 and can be used to rotate nut 42 when securing or removing the arrowhead from shaft 30. Tool 70 includes an elongate shaft 72 having a grip 78 at one end and a driver 76 at the other end. In the illustrated embodiment, shaft 72 has a three part shaft with the individual lengths of shaft 72 being threadingly secured together. Alternative embodiments of tool 70, however, may also be used. For example, the shaft of tool 70 can also take the form of a single piece rod that does not break down into smaller lengths. Tool 70 can be conveniently constructed by mounting a driving bit 76 on the end of a cleaning rod designed for use with .22 caliber rifles. Cleaning rods designed for .22 caliber rifles have a diameter that allows for their insertion into the bore of a conventional carbon fiber arrowshaft.

When installing the arrowhead, shaft 72 is assembled into a single elongate structure and the driver 76 is inserted into bore 29 at the aft end 34 of shaft 30. The driver 76 is then engaged with slots 68 on nut 42. The user then manually rotates grip 78 to turn nut 42 on stem 28 as the arrowhead is held in the desired rotational orientation.

After nut 42 has been firmly secured, tool 70 is extracted from bore 29 and nock 38 is positioned in bore 29 at the aft end 34 of shaft 30 thereby fully assembling the arrow. Nocks 38 are often press-fit in the aft end of an arrowshaft instead of permanently adhering the nock therein. Later removal of the nock from the aft end allows tool 70 to be later re-inserted in bore 29 if it is later desired to remove the arrowhead or adjust the rotational position of the arrowhead. As mentioned above, the capability to selectively adjust the rotational position of the arrowhead is useful when "tuning" an arrow.

Figure 5:
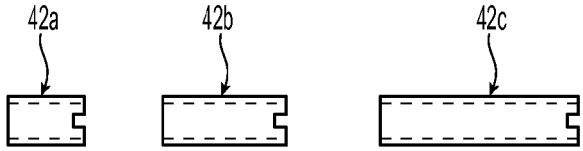
FIG. 5 is a view of a set of differently weighted nuts for an adjustable insert.

FIG. 5 illustrates how the adjustable insert assembly 22 can optionally be provided with multiple nuts 42*a*, 42*b*, 42*c* to further enhance the tuning capabilities of insert assembly 22. Nuts 42*a*, 42*b*, 42*c* have threaded interior bores and the same general construction and functionality as nut 42 but are provided as a set of three with sleeve 40. Each of the nuts 42*a*, 42*b*, 42*c* has a slightly different weight to thereby allow the user to select the nut 42*a*, 42*b*, 42*c* that provides the optimal weight distribution for arrow assembly 20. When tuning an arrow, it is often desirable to adjust the weight-forward or front-of-center weight of the arrow. The provision of differently weighted nuts 42*a*, 42*b*, 42*c* allows for the relatively easy adjustment of the front-of-center weight of the arrow assembly. Although the illustrated example shows the use of three differently weighted nuts, various other numbers of differently weighted nuts could be provided. For example, a set of five nuts having different weights could be used with the present invention.

In the illustrated embodiment, nuts 42*a*, 42*b*, 42*c* are made of the same material but have different lengths to thereby provide for the difference in weight between the individual nuts 42*a*, 42*b*, 42*c*. Alternative methods may also be employed to provide a plurality of nuts having different weights. For example, different materials having different densities could be used to provide differently weighted nuts having common dimensions, or, nuts having a common length and made of a common material could have one or more laterally extending bores formed therein to provide differently weighted nuts. Such lateral bores would extend perpendicular to the threaded axial bore of the nut. For an even broader range of weight adjustment, nuts 42*a*, 42*b*, 42*c* and sleeve 40 could all be provided in different materials having different densities. For example, these components could all be provided in both aluminum and stainless steel.

While the insert assembly 20 depicted in FIG. 1 works well with arrowshafts have a bore 29 that extends the entire length of shaft 30 and has openings on both the fore and aft ends of the shaft 30, not all arrowshafts have an aft opening. For example, prior to the development of carbon fiber arrowshafts, aluminum arrowshafts were quite popular. Although aluminum arrowshafts have recently fallen out of favor, many archers still use aluminum shafts. Aluminum shafts commonly have a closed aft end that does not allow a tool to be inserted into the shaft bore from the aft end.

Figure 6:
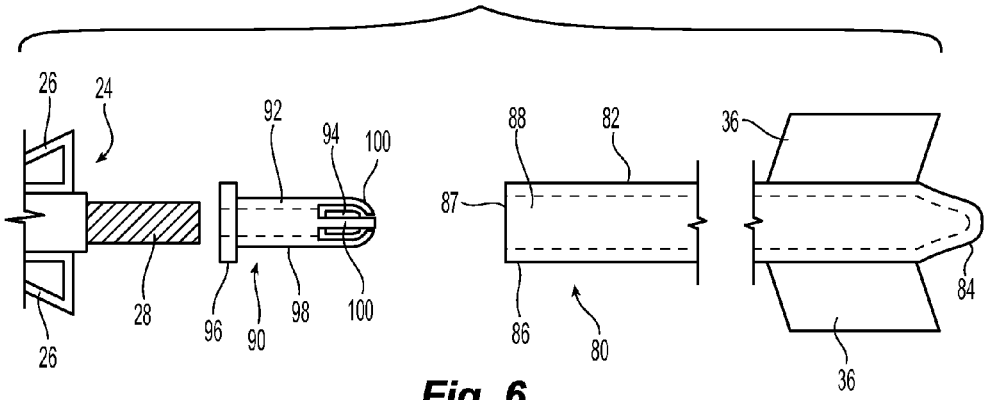
FIG. 6 is a partial exploded view of an alternative embodiment of the adjustable insert usable with arrowshafts having a shaft with a closed aft end.
Figure 8:
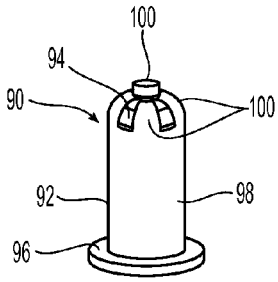
FIG. 8 is a perspective view of the adjustable insert of FIG. 6.
Figure 7:
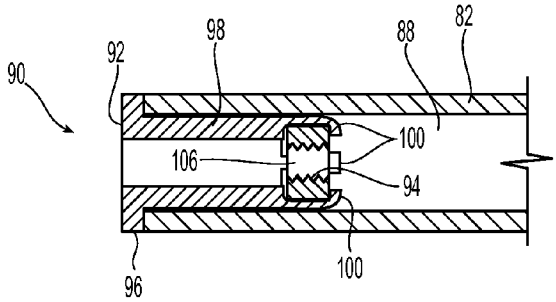
FIG. 7 is a cross sectional view of the adjustable insert of FIG. 6 in an installed condition.

FIG. 6 illustrates an arrow assembly 80 having an aluminum arrowshaft 82 with a closed aft end 84 and an insert assembly 90 that can be employed therewith. Aluminum shaft 82 includes fletchings 36 similar to shaft 30 and a fore end 86 having an opening 87 to substantially cylindrically shaped, longitudinally extending, blind bore 88. A conventional broadhead 24 and other arrowheads having a conventional threaded stem 28 can be used with insert assembly 90.

Figure 10:
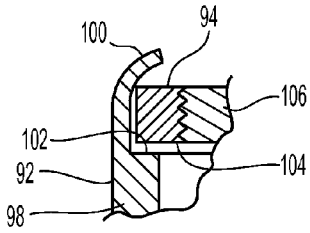
FIG. 10 is a partial cross sectional view of the adjustable insert of FIG. 6.

Insert assembly 90 includes a sleeve 92 and a nut 94. Sleeve 92 has a collar 96 and a tubular section 98 that are similar to the collar 44 and tubular section 48 of sleeve 40 and, thus, a discussion of these features will not be repeated. Sleeve 92 differs from sleeve 40 by including a plurality of crimping arms 100 that extend rearwardly from the back of tubular section 98. As best seen in FIG. 10, tubular section 98 defines an axial surface 102 facing the aft end 84 of shaft 82. Crimping arms 100 are located along the outer radial portion of surface 102 and define a radially inward shoulder which is engageable with axial surface 104 on the fore end of nut 94.

Figure 9:
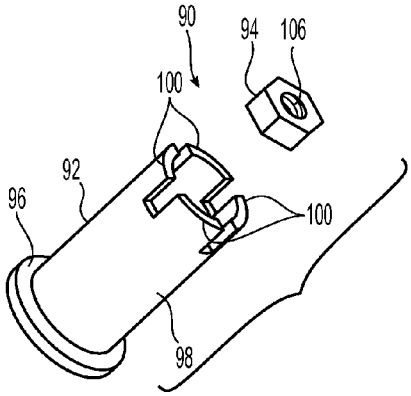
FIG. 9 is an exploded perspective view of the adjustable insert of FIG. 6 prior to assembly.

Crimping arms 100 axially capture nut 94 while still allowing limited rotational movement between nut 94 and sleeve 92. FIG. 9 illustrates sleeve 92 and nut 94 before final assembly of insert 90 and the inward crimping of arms 100. Nut 94 is positioned adjacent surface 102 while arms 100 are still straight as depicted in FIG. 9. The crimp arms 100 are then bent radially inwardly axially capturing nut 94 adjacent surface 102. The crimp arms 100 are not, however, so firmly engaged with nut 94 to prevent all rotation of nut 94.

After axially capturing nut 94 on sleeve 92 with crimp arms 100, insert assembly 90 is secured within shaft 82. When installing the insert assembly 90, tubular section 98 is secured to shaft 82 either by a sufficiently tight press-fit engagement or by means of an adhesive. After insert assembly 90 has been secured to shaft 82, an arrowhead 24 having a threaded stem 28 can be attached to assembly 90.

To attach arrowhead 24, threaded stem 28 is inserted through the central bore of sleeve 92 and engaged with threaded bore 106 of nut 94. The arrowhead is then rotated relative to shaft 82 to threadingly engage stem 28 with nut 94 and firmly secure stem 28 with nut 94 as surface 104 on nut 94 is brought into engagement with surface 102 on sleeve 92. If the final rotational position of the arrowhead is not the desired rotational position, the arrowhead is rotated in the opposite direction thereby loosening the arrowhead. Because there is some limited rotational movement between nut 94 and sleeve 92, when stem 28 of the arrowhead is once again engaged with nut 94 and the arrowhead is firmly secured by rotation relative to shaft 82, the final rotational position of the arrowhead will likely differ from the original rotational position of the secured arrowhead. If this second rotational position of the arrowhead is still not the desired rotational position, the process of loosening and re-securing the arrowhead is repeated until the arrowhead is secured in the desired rotational position.

Figure 16:
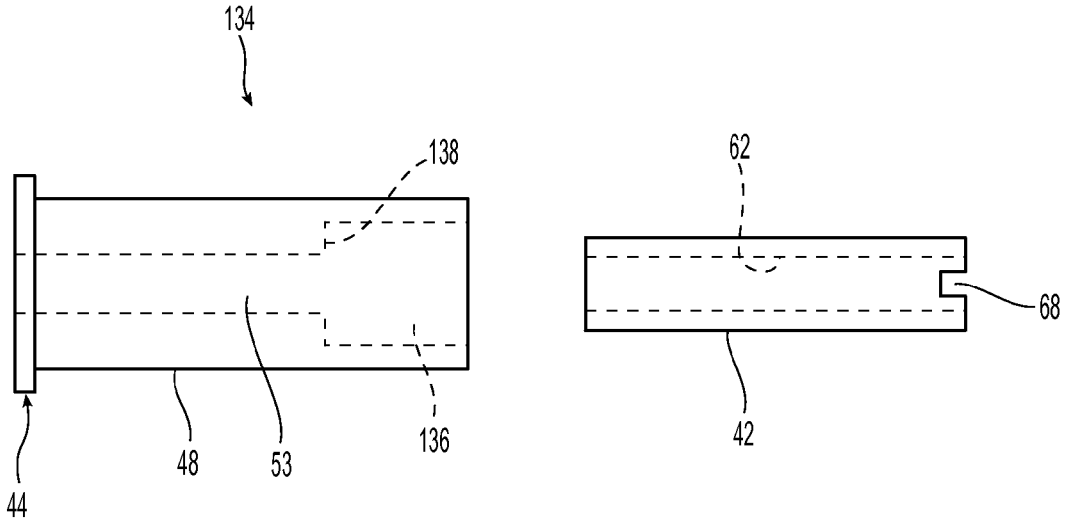
FIG. 16 is a side view of an alternative insert and nut which are adapted for use with a crossbow bolt.

Another alternative embodiment is shown in FIG. 16. The adjustable insert assembly depicted in FIG. 16 includes a sleeve 134 and a nut 42 which are adapted for use in a crossbow bolt. Crossbow bolts typically have shafts which are shorter than arrows used with other bows. Crossbow bolts also typically have a larger diameter shaft with a larger diameter inner bore in comparison to arrows used with other bows. The larger diameter inner bore of the crossbow bolt requires the use of a larger diameter sleeve 134. For example, many crossbow bolts have a length between about 20 to about 22 inches while arrows used with other bows typically have lengths which are between about 27 inches to about 32 inches. The inner diameter of many crossbow bolts is about 0.300 inches while the inner diameter or arrows for other bows is often about 0.25 inches. While such dimensions are commonly used with crossbows and other bows, various other dimensions can also be employed with the adjustable inserts disclosed herein.

Once consequence of using the shorter shaft typically employed with crossbow bolts is that such shafts are lighter than the shafts typically employed with arrows for other bows. The ability to increase the weight of a crossbow bolt is considered desirable by many archers and the insert assembly depicted in FIG. 16 provides a means for easily increasing the weight of the crossbow bolt. More specifically, sleeve 134 has a tubular section 48 with a collar 44 that engages the end of the shaft and an axially extending bore. The bore includes a smaller diameter section 53 proximate collar 44 and a larger diameter section 136 which receives nut 42.

The threaded stem of an arrowhead is inserted through smaller diameter section 53 and is engaged with the threaded bore 62 of nut 42. Nut 42 fits within bore section 136 and is tightened down into engagement with aft-facing surface 138 to secure the arrowhead to crossbow shaft. Slots 68 on nut 42 form an interface for engaging a driver inserted through the aft end of the crossbow shaft.

The use of a sleeve 134 having a bore with a larger diameter section 136 that receives nut 42 allows for the use of a longer and thereby heavier sleeve 134 with conventional arrowheads. Many arrowheads have a stem with a combined length of about 0.625 inches for a threaded stem including both a non-threaded shank and threaded length of the threaded stem. Thus, for arrowheads with a threaded stem length of 0.625 inches, the length of small diameter section 53 must be sufficiently shorter than 0.625 inches to allow for nut 42 to firmly engage the threaded stem. If nuts having an outer diameter sufficiently small to fit within a conventional arrow shaft are used when securing an arrowhead to a crossbow bolt, sleeve 134 can extend aft of engagement surface 138 without interfering with nut 42 and thereby increase the weight of sleeve 134. In the embodiment illustrated in FIG. 16, sleeve 134 is approximately 80 grams while nut 42 is approximately 50 grams, however, various other weights for sleeve 134 and nut 42 may also be employed with the present invention. Larger diameter nuts 42 could also be employed in crossbow shafts to provide increased weight, however, the embodiment depicted in FIG. 16 allows nuts 42 suitable for conventional arrowshafts to be used in crossbow bolts while still providing enhanced weight for the insert assembly.

Figure 11:
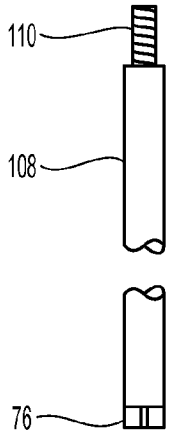
FIG. 11 is a side view of an alternative installation tool.

FIGS. 11-15 illustrate alternative tools that can be used to install and remove adjustable insert assembly 22. FIG. 11 illustrates an elongate rod 108 having a driver 76 at one end and a threaded section 110 at the opposite end. As can be seen in FIG. 11, elongate rod 108 is generally similar to tool 70 but has a continuous shaft rather than a separable shaft and has a threaded section 110 instead of grip 78. Threaded section 110 is engageable with nut 42 whereby if it is desired to remove a nut 42 from an arrowshaft 30, threaded section 110 can be threaded into engagement with threaded bore 62 of the nut 42 and then the elongate rod 108 and attached nut 42 can be pulled from the arrowshaft 30.

The use of a tool having a threaded section 110 can be particularly useful when using a plurality of nuts having different weights such as those depicted in FIG. 5. For example, the first nut 42*a* could be initially installed and the assembled arrow could be shot to determine how well it flew. Nut 42*a* could then be removed and one of the other nuts 42*b*, 42*c* could then installed and the arrow tested again. After installing and testing each of the nuts 42*a*, 42*b*, 42*c*, the one which performed best with the arrow could be re-installed. Oftentimes, archers/hunters will assemble multiple arrows having the same general configuration. After determining the most effective weight nut on the initial arrow, the archer could then assemble numerous arrows having the same configuration as the initial arrow, e.g., same shaft material and length, same fletchings, same arrowhead and same weight nut 42*a*, 42*b* or 42*c*.

Figure 12:
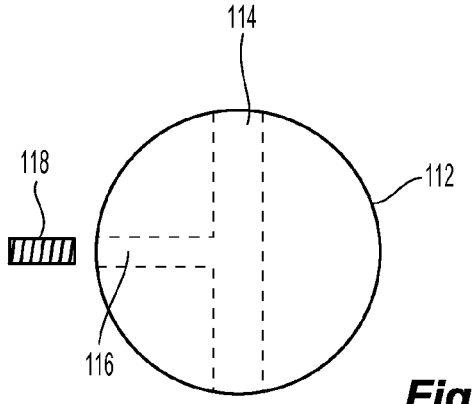
FIG. 12 is a side view of a grip for use with an installation tool.
Figure 13:
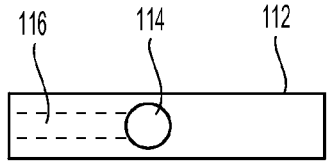
FIG. 13 is an end view of an installation tool grip.

Returning now to the discussion of elongate rod 108, a repositionable grip 112 is provided to rotate rod 108. As can be seen in FIGS. 12 and 13, grip 112 includes a through bore 114 through which rod 108 can be inserted. Grip 112 also includes a threaded cross bore 116 which intersects through bore 114. A set screw 118 is positioned in threaded bore. When grip 112 is positioned at the desired location on elongate rod 108, set screw 118 is rotated into tight engagement with rod 108 to thereby secure grip 112 in place. Grip 112 can then be used to rotate rod 108 when installing and removing nuts 42. When it is desired to reposition grip 112, set screw 118 is loosened thereby allowing grip 112 to be repositioned on rod 108 or removed therefrom. Set screw has one end (not shown) which is adapted for engagement with a driver such as an Allen wrench or screwdriver as will be readily understood by a person having ordinary skill in the art.

Conventional arrows are typically no more than 32 inches in length and a rod 108 having a length of approximately 32 and ⅜ inches will work with nearly all arrows. Or course a suitably longer rod 108 could be provided for use with custom arrows having a longer length. For most hunters and non-hunting archers, transporting rod 108 and grip 112 will not pose a difficulty. Rod 108 will generally not be significantly longer than the associated arrows. As a result, rod 108 will oftentimes be easily transported in a quiver or bow case that the archer/hunter uses to transport his arrows.

Although rod 108 depicted in FIG. 11 is a solid continuous rod which cannot be broken down into shorter lengths, it could alternatively be formed out of several shorter shaft lengths in a manner similar to tool 70. Collapsible rods may also be employed. Rods which can be broken down or collapsed provide even greater options for storing and transporting the rod.

Figure 14:
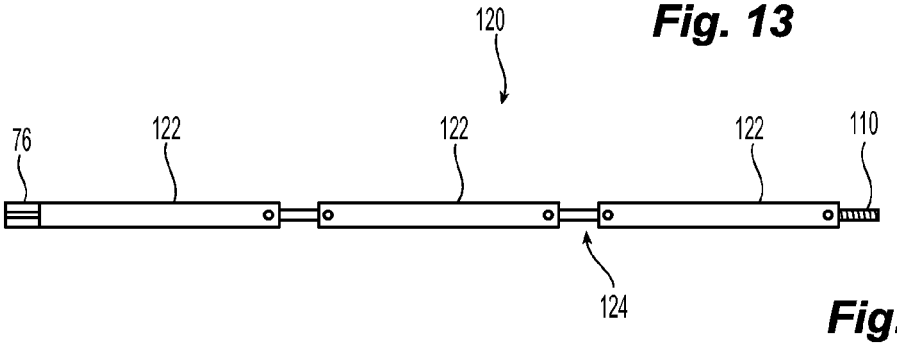
FIG. 14 is side view of an alternative installation tool with pivotal links.
Figure 15:
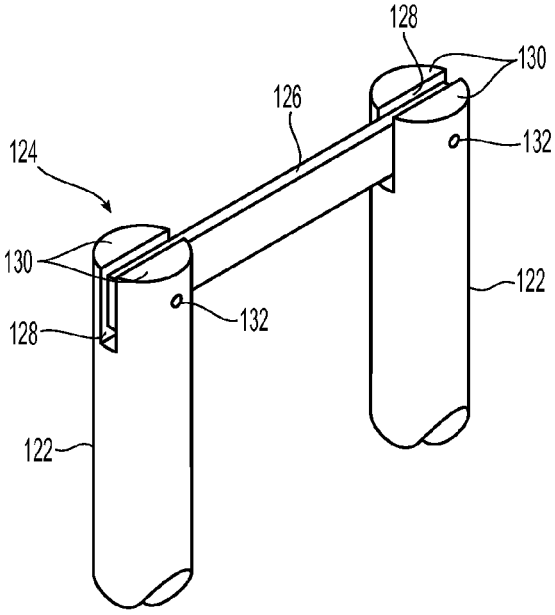
FIG. 15 is a perspective view of a pivotal link.

An example of a pivotally collapsible rod 120 is depicted in FIGS. 14 and 15. The illustrated rod 120 has three short shaft lengths 122 which are connected by pivotal links 124. Similar to elongate rod 108, collapsible rod 120 has a driver 76 at one end and a threaded section 110 at the opposite end. FIG. 14 illustrates rod 120 in an extended configuration which allows rod 120 to be inserted into the bore 29 of an arrowshaft 30. A grip 112 can be secured on rod 120 and rod 120 can be used in the same manner as elongate rod 108 to install and remove insert assemblies 22. In this regard, it is noted that when a pivotal link 124 is positioned within the bore 29 of an arrowshaft 30, arrowshaft 30 will restrain the pivotal movement of link 124.

When not in use, rod 120 can be collapsed to approximately one third of its fully extended length by means of pivotal links 124. Although the illustrated rod 120 has two links 124 and can be collapsed to one third its fully extended length, more or fewer links 124 can also be employed. For example, a single link 124 could be used to collapse an alternative rod configuration to approximately one half its fully extended length or three lengths could be employed to collapse a rod to approximately one fourth its fully extended length.

Pivotal links 124 are best understood with reference to FIG. 15. Pivotal links 124 include a link member 126 which takes the form of a small flat bar in the illustrated embodiment. Slots 128 are formed in adjacent ends of shaft lengths 122 creating a pair of arms 130 on the end of each shaft length 122. Holes are drilled or otherwise formed in arms 130 and near each end of link member 126 to receive pivot pins 132. Slot 128 is advantageously formed sufficiently deep such that the bottom of slot 128 does not limit the rotation of link member 126. The use of a such a deep slot will allow link members 126 to rotate sufficiently to allow shaft lengths 122 to be positioned immediately adjacent along their full length when rod 120 is positioned in a collapsed configuration.

While this invention has been described as having an exemplary design, the present invention may be further modified within the spirit and scope of this disclosure. This application is therefore intended to cover any variations, uses, or adaptations of the invention using its general principles.

What is claimed is:

1. An arrow insert assembly adapted for installation in an arrowshaft having a longitudinally extending bore and further adapted to secure an arrowhead including a threaded stem to the arrowshaft, the insert assembly comprising:

a hollow tubular sleeve securable within the bore of the arrowshaft;

a nut having a threaded bore and being rotatably positionable within the bore of the arrowshaft aft of at least a portion of the tubular sleeve wherein the arrowhead is securable to the arrowshaft in a desired rotational position by extending the threaded stem through the tubular sleeve and securely engaging the threaded stem with the threaded bore of the nut.

2. The arrow insert assembly of claim 1 wherein the tubular sleeve is non-threaded and includes a radially outward projecting collar engageable with an axial end of the arrowshaft and wherein the nut is engageable with a tool and the arrowhead is firmly securable to the arrowshaft by extending the tool through the bore of the arrowshaft from an aft end of the bore to engage the nut and drivingly rotating the nut while the arrowhead is positioned in the desired rotational position to thereby firmly engage the arrowhead with the collar and the nut with an aft-facing surface of the tubular sleeve.

3. The arrow insert assembly of claim 1 wherein the nut is axially captured on the tubular sleeve and is rotatable relative to the tubular sleeve, the arrowhead being securable to the arrowshaft by inserting the threaded stem through to the tubular sleeve to engage the threaded stem with the nut and rotating the arrowhead relative to the arrowshaft and wherein the arrowhead is attachable in the desired rotational position by repeatedly unsecuring and securing the arrowhead to the arrowshaft until the selected rotational position is achieved.

4. The arrow insert assembly of claim 1 further comprising a tool engageable with the nut wherein the arrowhead is firmly securable to the arrowshaft by extending the tool through the arrowshaft from the aft end of the arrowshaft to engage the nut and drivingly rotating the nut while the arrowhead is positioned in the desired rotational position.

5. The arrow insert assembly of claim 4 wherein one end of the tool defines a driver engageable with the nut to drivingly rotate the nut and wherein an opposite end of the tool defines a threaded section engageable with the threaded bore of the nut whereby the tool can be used to remove the nut from the bore of the arrowshaft.

6. The arrow insert assembly of claim 5 wherein the tool further comprises a grip repositionably securable on the tool wherein, when secured to the tool, rotation of the grip drivingly rotates the tool.

7. The arrow insert assembly of claim 5 wherein the tool has a collapsible shaft with at least one pivotal link.

8. The arrow insert assembly of claim 1 wherein the nut comprises a plurality of nuts, each of the plurality of nuts having a threaded bore and being rotatably positionable within the bore of the arrowshaft aft of at least a portion of the tubular sleeve wherein the arrowhead is securable to the arrowshaft in the desired rotational position by extending the threaded stem through the tubular sleeve and securely engaging the threaded stem with the threaded bore of the nut, the plurality of nuts defining a plurality of different weights whereby a selected one of the nuts can be utilized to secure the arrowhead to selectively control the distribution of weight along the arrowshaft.

9. An arrow assembly comprising:

an arrowshaft having a longitudinally extending bore;

a hollow tubular sleeve secured within the bore of the arrowshaft;

an arrowhead including a plurality of outwardly extending blades and a threaded stem, the stem being fixed and immovable relative to the blades; and a nut having a threaded bore and being rotatable relative to the tubular sleeve, the nut being positioned aft of at least a portion of the tubular sleeve wherein the arrowhead is secured to the arrowshaft by extending the threaded stem through the tubular sleeve to securely engage the threaded bore of the nut.

10. The arrow assembly of claim 9 wherein the nut is axially captured on the tubular sleeve, the arrowhead being secured to the arrowshaft by inserting the threaded stem through to the tubular sleeve to engage the threaded bore of the nut and then rotating the arrowhead relative to the arrowshaft wherein the arrowhead is attachable in a desired rotational position by repeatedly unsecuring and securing the arrowhead to the arrowshaft until the desired rotational position is achieved.

11. The arrow assembly of claim 9 further comprising a tool wherein the nut is engageable with the tool and the arrowhead is firmly secured in a desired rotational position by extending the tool through the bore of the arrowshaft from an aft end of the bore to engage the nut and drivingly rotating the nut while the arrowhead is positioned in the desired rotational position.

12. The arrow assembly of claim 11 wherein one end of the tool defines a driver engageable with the nut to drivingly rotate the nut and wherein an opposite end of the tool defines a threaded section engageable with the threaded bore of the nut whereby the tool can be used to remove the nut from the bore of the arrowshaft.

13. The arrow assembly of claim 12 wherein the tool further comprises a grip repositionably securable on the tool wherein, when secured to the tool, rotation of the grip drivingly rotates the tool.

14. The arrow assembly of claim 12 wherein the tool has a collapsible shaft with at least one pivotal link.

15. The arrow assembly of claim 9 wherein the tubular sleeve is non-threaded and includes a radially outward projecting collar engaged with an axial end of the arrowshaft and wherein following securement of the arrowhead, the arrowhead engages the collar and the nut engages an aft-facing surface of the tubular sleeve.

16. The arrow assembly of claim 9 wherein the nut comprises a plurality of nuts, each of the plurality of nuts having a threaded bore and being rotatably positionable within the bore of the arrowshaft aft of the tubular sleeve wherein the arrowhead is securable to the arrowshaft in a desired rotational position by extending the threaded stem through the tubular sleeve and securely engaging the threaded stem with the threaded bore of the nut, the plurality of nuts defining a plurality of different weights whereby a selected one of the nuts can be utilized to secure the arrowhead to selectively control the distribution of weight along the arrowshaft.

17. A method of securing an arrowhead having a threaded stem to an arrowshaft having a longitudinally extending bore, said method comprising:

installing a hollow tubular sleeve within the bore of the arrowshaft;

positioning a nut having a threaded bore within the bore and aft of at least a portion of the sleeve, the nut being rotatable relative to the tubular sleeve; and securing the arrowhead in a desired rotational position by inserting the threaded stem of the arrowhead through the sleeve and threadingly and securely engaging the stem with the threaded bore of the nut.

18. The method of claim 17 wherein the step of securing the arrowhead comprises inserting a tool into the bore of the arrowshaft from the aft end of the bore to engage the nut and rotating the tool to tighten the nut on the threaded stem while holding the arrowhead in the desired rotational position until the arrowhead is securely engaged with the nut.

19. The method of claim 18 wherein the nut comprises a plurality of nuts defining a plurality of different weights and the step of securing the arrowhead comprises selecting one of the plurality of nuts having a desired weight to position in the bore and engage the threaded stem to thereby selectively control the distribution of weight along the arrowshaft.

20. The method of claim 19 wherein one end of the tool defines a driver engageable with the nut to drivingly rotate the nut and an opposite end of the tool defines a threaded section engageable with one of the plurality of nuts positioned in the bore and wherein the method further comprises:

positioning a first one of the plurality of nuts in the bore, engaging the threaded bore of the nut with the threaded section of the tool and removing the first nut from the bore of the arrowshaft by removing the tool from the bore.

* * * * *